US011549171B1

(12) United States Patent
Chaudhari et al.

(10) Patent No.: US 11,549,171 B1
(45) Date of Patent: Jan. 10, 2023

(54) METHOD OF TREATING AN ARTICLE

(71) Applicant: Fluid Controls Pvt. Ltd., Mumbai (IN)

(72) Inventors: Tansen Dhananjay Chaudhari, Pune (IN); Rahul Manikrao Patil, Pune (IN)

(73) Assignee: FLUID CONTROLS PVT. LTD., Mumbai (IN)

( * ) Notice: Subject to any disclaimer, the term of this patent is extended or adjusted under 35 U.S.C. 154(b) by 0 days.

(21) Appl. No.: 17/669,180

(22) Filed: Mar. 11, 2022

(51) Int. Cl.
*C23C 8/50* (2006.01)
*C23C 8/80* (2006.01)
*C21D 1/06* (2006.01)

(52) U.S. Cl.
CPC ..... *C23C 8/50* (2013.01); *C21D 1/06* (2013.01); *C23C 8/80* (2013.01)

(58) Field of Classification Search
CPC ..... C23C 8/50; C23C 8/80; C21D 1/06
See application file for complete search history.

(56) References Cited

U.S. PATENT DOCUMENTS 4,019,928 A * 4/1977 Beyer ..... C23C 8/40 148/228

FOREIGN PATENT DOCUMENTS

| | | | |
|---|---|---|---|
| CN | 109161840 | A | 1/2019 |
| CN | 111041408 | A | 4/2020 |
| CN | 111519128 | A | 8/2020 |
| WO | 2012146839 | A1 | 11/2012 |

* cited by examiner

*Primary Examiner* — Jessee R Roe
(74) *Attorney, Agent, or Firm* — Hassan Abbas Shakir; Shakir Law PLLC

(57) ABSTRACT

An embodiment of the invention describes a method of treating an article to improve its corrosion resistance. The method includes the step of nitriding the article in a cyanide-free nitriding bath to obtain a nitrided article, heating the nitrided article in an atmosphere having nitrogen and carbon-carburizing to obtain a nitrided oxidised article. Further, in certain embodiments, the oxidised nitrided article may be coated with a metallic layer. The oxidised nitrided article with the metallic coating has improved corrosion resistance.

16 Claims, 2 Drawing Sheets

METHOD OF TREATING AN ARTICLE

1. TECHNICAL FIELD

The present invention generally relates to the field of heat treatment of metallic articles. More particularly, the invention relates to a method of heat treating ferrules.

2. BACKGROUND

Methods of treating metallic articles are well known in the art. More specifically, methods of heat treating metallic articles are known and used in order to improve the properties of these metallic articles. For example, Chinese patent application CN111519128A describes a method of treating automobile pistons by heating the piston in a salt bath nitriding furnace, followed by multiple steps of heating the piston in nitrogen atmosphere, followed by oxidation in a salt bath oxidation furnace. However, the article does not describe the corrosion resistance of the piston. Further, this process is designed to replace chromium coating, and uses cyanide, which is a highly toxic chemical. Similarly, Chinese patent application CN111041408A describes a method of treating hydraulic vane parts using a salt bath nitriding followed by a salt bath oxidising step to destroy any cyanide produced by the nitriding process, and to form a black film on the surface of the articles. PCT application WO2012146839A1 and Chinese application CN109161840A describe methods of nitriding articles to improve the hardness of the metal articles. However, these methods fail to address the need for high hardness and high corrosion resistance for the articles, that are exposed to corrosive atmospheres for extended periods of time.

Accordingly, there remains a need for a method of treating metallic articles, which provides improved corrosion resistance, and obviates the aforesaid drawbacks.

3. OBJECTS OF THE INVENTION/SUMMARY OF THE INVENTION

An object of the present invention is to provide a method of treating an article. The method includes the steps of, heating the article to a temperature in a range of about 500 degrees centigrade to about 600 degrees centigrade in a cyanide-free nitriding bath to obtain a nitrided article, heating the nitrided article to a temperature in a range of about 450 degrees centigrade to about 550 degrees centigrade in an atmosphere having nitrogen and carbon to obtain an oxidized nitrided article. The oxidized nitrided article has a corrosion resistance at least 10 times the corrosion resistance of the article being treated.

Another embodiment of the present invention is to provide a method of treating an article. The method includes the steps of, heating the article to a temperature in a range of about 500 degrees centigrade to about 600 degrees centigrade in a cyanide-free nitriding bath to obtain a nitrided article, heating the nitrided article to a temperature in a range of about 450 degrees centigrade to about 550 degrees centigrade in an atmosphere having nitrogen and carbon to obtain an oxidized nitrided article. The method further includes the step of coating the oxidized nitrided article with a metallic coating to form a metal coated oxidized nitrided article. The metal coated oxidized nitrided article has a corrosion resistance at least twenty times the corrosion resistance of the article.

These and other objects of the invention herein will be better appreciated and understood when considered in conjunction with the following description and the accompanying drawings. It should be understood, however that the following descriptions, while indicating embodiments and numerous specific details thereof, are given by way of illustration and not of limitation. Many changes and modifications may be made within the scope of the embodiments herein without departing the spirit thereof, and the embodiments herein include all such modifications.

4. BRIEF DESCRIPTION OF DRAWINGS

The embodiments of the invention are illustrated in the accompanying drawings, throughout which the reference letters indicate corresponding part in the various figures. The embodiments herein will be better understood from the following description with reference to the drawings, in which.

5. DETAILED DESCRIPTION OF THE INVENTION

Figure 1:
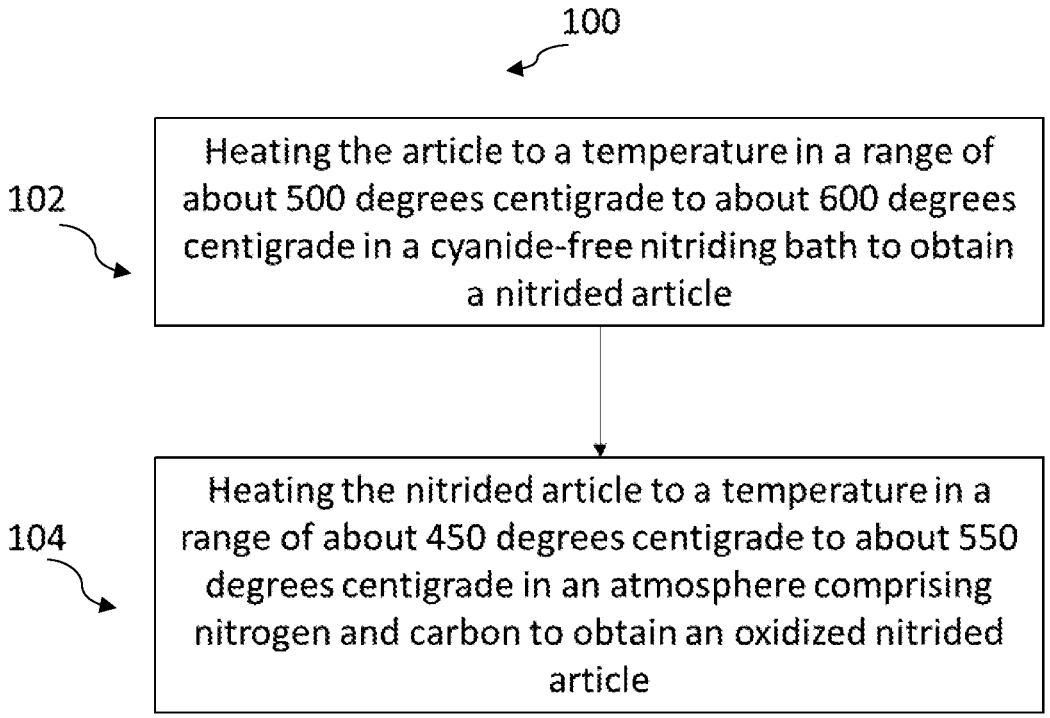
FIG. 1 illustrates a method of treating an article in accordance with an embodiment of the invention.

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

In the specification and the claims which follow, reference will be made to a number of terms which shall be defined to have the following meanings:

The singular forms "a", "an" and "the" include plural referents unless the context clearly dictates otherwise. "Optional" or "optionally" means that the subsequently described event or circumstance may or may not occur, and that the description includes instances where the event occurs and instances where it does not. "Substantially" means a range of values that is known in the art to refer to a range of values that are close to, but not necessarily equal to a certain value.

Other than in the examples or where otherwise indicated, all numbers or expressions referring to quantities of ingredients, reaction conditions, and the like, used in the specification and claims are to be understood as modified in all instances by the term "about." In some aspects of the current disclosure, the terms "about" or "approximately" are defined as being close to as understood by one of ordinary skill in the art, and in one non-limiting embodiment the terms are defined to be within 10%, alternatively within 5%, alternatively within 1%, or alternatively within 0.5%.

As used herein, the term "substantially" and its variations are defined as being largely but not necessarily wholly what is specified as understood by one of ordinary skill in the art, and in one non-limiting aspect substantially refers to ranges within 10%, within 5%, within 1%, or within 0.5%.

Various numerical ranges are disclosed herein. Because these ranges are continuous, they include every value between the minimum and maximum values. The endpoints of all ranges reciting the same characteristic or component are independently combinable and inclusive of the recited endpoint. Unless expressly indicated otherwise, the various numerical ranges specified in this application are approximations. The endpoints of all ranges directed to the same component or property are inclusive of the endpoint and independently combinable. The term "from more than 0 to an amount" means that the named component is present in some amount more than 0, and up to and including the higher named amount.

As used herein, "combinations thereof" is inclusive of one or more of the recited elements, optionally together with a like element not recited, e.g., inclusive of a combination of one or more of the named components, optionally with one or more other components not specifically named that have essentially the same function. As used herein, the term "combination" is inclusive of blends, mixtures, alloys, reaction products, and the like.

As used herein, the term "bite type fitting" refers to an article that is used for joining two tubes. The bite type fitting is composed of an outer compression nut and an inner compression ferrule. When the nut is tightened, the ferrule is compressed between the nut and the body of the fitting, thus forming a tight, leak-proof joint.

As used herein the term "standard cubic centimetres per minute" or "sccm" is defined as a gas flow rate corresponding to a cubic centimeter of gas flowing in one minute. As used herein the term "litres per minute" or "1 pm" is defined as a gas flow rate corresponding to one litre of gas flowing in one minute.

One embodiment of the present invention is a method of treating an article. The method includes the steps of, heating the article to a temperature in a range of about 500 degrees centigrade to about 600 degrees centigrade in a cyanide-free nitriding bath to obtain a nitrided article, heating the nitrided article to a temperature in a range of about 450 degrees centigrade to about 550 degrees centigrade in an atmosphere having nitrogen and carbon to obtain an oxidized nitrided article. The oxidized nitrided article has a corrosion resistance at least 10 times the corrosion resistance of the article being treated.

A method of treating an article in accordance with one embodiment of the present invention will now be described with reference to the drawings.

As shown in FIG. 1, a method of treating an article in accordance with one embodiment of the present invention is depicted. The method includes the steps of heating 102 the article to a temperature in a range of about 500 degrees centigrade to about 600 degrees centigrade in a cyanide-free nitriding bath to obtain a nitrided article, heating 104 the nitrided article to a temperature in a range of about 450 degrees centigrade to about 550 degrees centigrade in an atmosphere comprising nitrogen and carbon to obtain an oxidized nitrided article. The oxidized nitrided article has a corrosion resistance at least 10 times the corrosion resistance of the article.

In an embodiment of the present invention, the article may include a low carbon steel. In an embodiment of the present invention, the article may include an "EN1A" grade steel.

In an embodiment of the present invention, the article may be a gear, a sprocket, a screw, a ball bearing, a roller bearing, a piston pin, a firearm, a chain, a lock shackle, a watch case, a cam shaft, a crankshaft, a ferrule, and the like. In an embodiment of the present invention, the article may be a ferrule. In yet another embodiment the article may be a ferrule such as a bite-type ferrule, a single ferrule, or a double ferrule. In an example embodiment the article may be a bite-type ferrule.

In an embodiment of the present invention, the cyanide-free nitriding bath includes about 31 percent to about 40 percent of cyanate, about 17 percent to about 25 percent of carbonate, and less than about 1 percent of a cyanide compound. In an embodiment of the present invention, the cyanide-free nitriding bath includes about 36 percent to about 40 percent of cyanate, about 17 percent to about 21 percent of carbonate, and less than about 1 percent of a cyanide compound. In another embodiment of the present invention, the cyanide-free nitriding bath includes about 31 percent to about 40 percent of cyanate, about 17 percent to about 21 percent of carbonate, about 15 percent to about 25 percent of sodium, about 20 percent to about 30 percent of potassium, about 1 percent to about 6 percent of lithium, less than about 1 percent of sulphur, and less than about 1 percent of a cyanide compound.

In an embodiment of the present invention, the cyanide-free nitriding bath has cyanide in a range of less than about 1 percent. In an embodiment of the present invention, the cyanide-free nitriding bath has cyanide in a range of about 0 percent to about 1 percent.

In an embodiment of the present invention, the atmosphere includes nitrogen and carbon further includes compressed air. In an embodiment of the present invention, the atmosphere includes nitrogen and carbon has a flow rate from about 400 litres per minute to about 500 litres per minute. In an embodiment of the present invention, the atmosphere comprising nitrogen and carbon has a flow rate of about 450 litres per minute.

In an embodiment of the present invention, the method further includes the step of soaking the oxidised nitrided article in a water bath at a temperature in the range of from about 40 degrees centigrade to about 60 degrees centigrade for a time of about 2 hours to about 3 hours.

In an embodiment of the present invention, the method further includes the step of the step of coating the oxidized nitrided article with a metallic coating to form a metal coated oxidized nitrided article. In an embodiment of the present invention, the metallic coating comprises a zinc, nickel or a zinc-nickel alloy. In an embodiment of the present invention, the thickness of the metallic coating may be from about 5 microns to about 15 microns. In another embodiment of the present invention, the thickness of the metallic coating may be from about 8 microns to about 12 microns.

In an embodiment of the present invention, the metallic coating is deposited by an electrodeposition method.

In an embodiment of the present invention, the metal coated oxidized nitrided article has a corrosion resistance of at least twenty times the article. In another embodiment the metal coated nitrided article has a corrosion resistance from about twenty times to about thirty times the corrosion resistance of the article. In yet another embodiment the metal coated nitrided article has a corrosion resistance of about twenty times to about twenty five times the corrosion resistance of the article.

Figure 2:
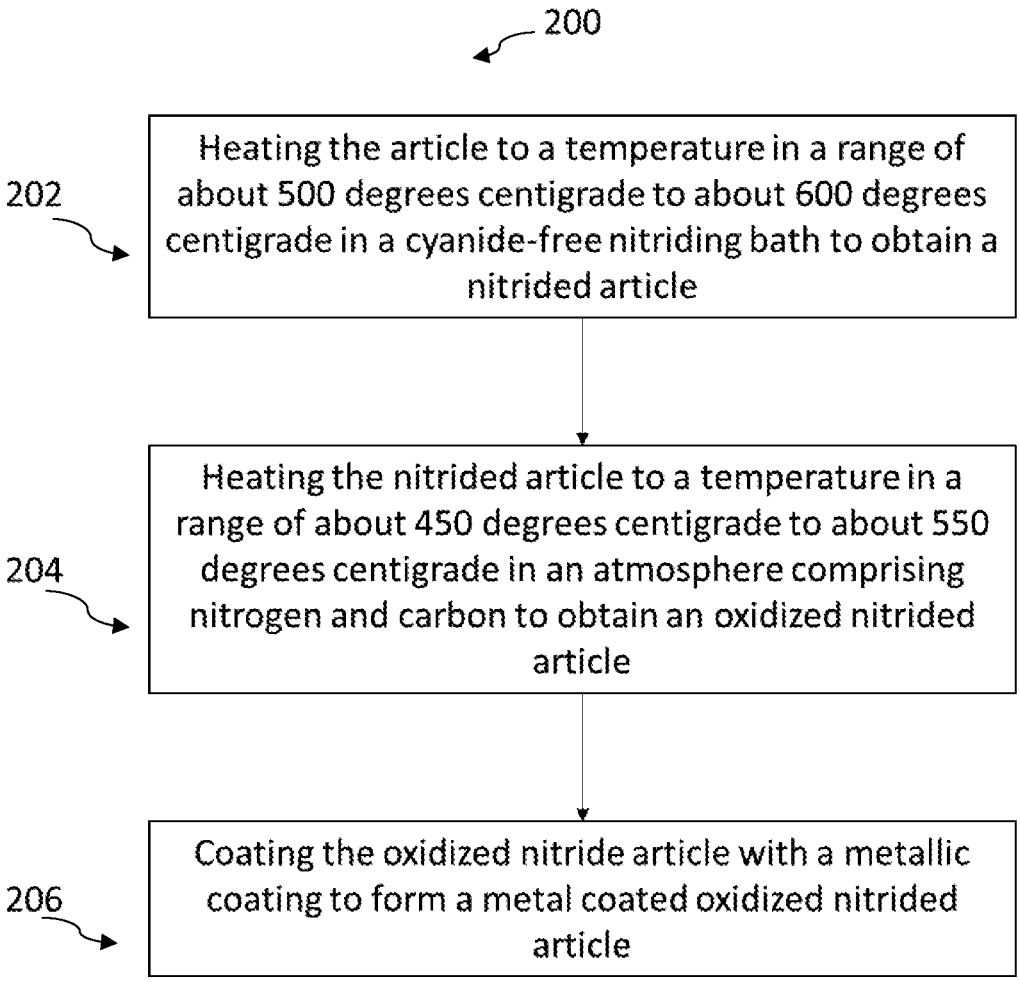
FIG. 2 illustrates a method of treating an article in accordance another with embodiment of the invention.

Referring now to FIG. 2, a method of treating an article in accordance with another embodiment of the present invention is shown. The method includes the steps of heating 202 the article to a temperature in a range of about 500 degrees centigrade to about 600 degrees centigrade in a cyanide-free nitriding bath to obtain a nitrided article, heating 204 the nitrided article to a temperature in a range of about 450 degrees centigrade to about 550 degrees centigrade in an atmosphere comprising nitrogen and carbon to obtain an oxidized nitrided article, and coating 206 the oxidized nitrided article with a metallic coating to form a metal coated oxidized nitrided article, wherein the metal coated oxidized nitrided article has a corrosion resistance at least twenty times the corrosion resistance of the article.

In an embodiment of the present invention, the metallic coating comprises a zinc, nickel or a zinc-nickel alloy.

EXAMPLES

Example 1: Commercially available ferrules, such as those manufactured by Fluid Controls Pvt. Ltd., Pune, India, were obtained for heat treatment. The ferrules were washed with acetone to remove grease and dirt. The ferrules were then placed in a cyanide free bath. The cyanide free bath had the following composition: about 36 percent of cyanate, about 18 percent of carbonate, about 20 percent of sodium, about 25 percent of potassium, about 3 percent of lithium, less than about 1 percent of sulphur, and less than about 1 percent of a cyanide compound. The bath was heated to a temperature of about 550 degrees centigrade and maintained at this temperature for about 4 hours. Subsequently, the ferrules were removed, and placed in a water bath at about 50 degrees centigrade for a period of about 2 hours, to obtain a nitrided ferrule. The nitrided ferrule was then placed in a furnace at about 550 degrees centigrade for about 4 hours in the presence of an atmosphere of compressed air flowing at about 450 litres per minute.

The hardness of these oxidised nitrided ferrules was measured. The hardness of the nitrided ferrule was measured to be about 300 Vickers Hardness (HV), similar to the hardness of about 300 Vickers Hardness for the original ferrule. The hardness of the oxidised nitrided ferrule was measured to be about 750 Vickers Hardness (HV). Salt spray corrosion resistance was measured according to ASTM B117. It was observed that the corrosion resistance of the ferrule, according to ASTM B117 was about 12 hours. In contrast, the corrosion of the oxidised nitrided ferrule was about 144 hours, i.e. the corrosion resistance of the oxidised nitrided ferrule is about 12 times that of the original untreated ferrule.

Example 2: An oxidised nitrided ferrule was prepared according to the process described in Example 1. The oxidised nitrided ferrule was then coated with a layer of metallic zinc having a thickness from about 8 microns to about 12 microns by an electrodeposition process, followed by a surface oxidation process. Salt spray corrosion resistance was measured according to ASTM B117.

It was observed that the corrosion resistance of the ferrule, according to ASTM B117 was about 12 hours. In contrast, the corrosion of the oxidised nitrided ferrule was about 256 hours, i.e. the corrosion resistance of the oxidised nitrided ferrule is about 20 times that of the original untreated ferrule. It was observed that the hardness of the zinc coated oxidised nitrided ferrule was about 700 Vickers Hardness (HV) to about 750 Vickers Hardness (HV), about three times higher than the hardness of the untreated ferrule. It was observed that the zinc coating increased the corrosion resistance of the oxidised nitrided ferrule, while the oxidation step improved the finish of the ferrule, also preventing formation of white rust on the ferrule.

Example 3: An oxidised nitrided ferrule was prepared according to the process described in Example 1. The oxidised nitrided ferrule was then coated with a layer of metallic zinc-nickel alloy comprising about 85% of zinc, and about 15 percent of nickel, having a thickness from about 10 microns.

The zinc-nickel alloy was coated on to the oxidised nitrided ferrule by an electroplating process, followed by an oxidation step. Salt spray corrosion resistance was measured according to ASTM B117. It was observed that the corrosion resistance of the ferrule, according to ASTM B117 was about 720 hours. In contrast, the corrosion of the oxidised nitrided ferrule was about 256 hours, i.e. the corrosion resistance of the oxidised nitrided ferrule is about 60 times that of the original untreated ferrule. It was observed that the hardness of the Zinc-nickel alloy coated oxidised nitrided ferrule was about 700 Vickers Hardness (HV) to about 750 Vickers Hardness (HV), about three times higher than the hardness of the untreated ferrule. It was observed that the zinc-nickel alloy coating increased the corrosion resistance of the oxidised nitrided ferrule, while the oxidation step improved the finish of the ferrule, also preventing formation of white rust on the ferrule.

Comparative Example 1 (C. Ex1): Commercially available ferrules, such as those manufactured by Fluid Controls Pvt. Ltd., Pune, India, were obtained. Salt spray corrosion resistance was measured according to ASTM B117. It was observed that the corrosion resistance of the ferrule, according to ASTM B117 was about 12 hours.

TABLE 1

| Example | Ferrule type | Vickers Hardness (HV) | Corrosion resistance [ASTM B117] (in hours) |
|---|---|---|---|
| C. Ex 1 | Untreated ferrule | 250-300 | 12 |
| Example 1 | Oxidised nitrided ferrule | 250-300 | 144 |
| Example 2 | Zinc coated oxidised nitrided ferrule | 700-750 | 256 |
| Example 3 | Zinc-nickel alloy coated oxidised nitrided ferrule | 700 -750 | 720 |

Table 1 shows a summary of the properties of various ferrules described in the examples. As can be seen from the Table 1 the corrosion resistance of the ferrules obtained in Examples 1-3 have a much higher corrosion resistance, as compared to the untreated ferrule of C. Ex. 1. Also, it is observed that the oxidized nitrided ferule of Example 1 has a hardness that is similar to the untreated ferrule. The hardness of the zinc coated and zinc-nickel alloy coated oxidised nitrided ferrules is much higher, almost three times that of the untreated ferrule.

Advantages:

The technical advantages brought in by the present invention are as follows:

1. The oxidized nitrided article has a corrosion resistance at least 10 times the corrosion resistance of the article.

2. The metal coated oxidized nitrided article has a corrosion resistance at least twenty times the corrosion resistance of the article.

3. The oxidised d have a hardness from about 700 Vickers Hardness to about 750 Vickers Hardness.

4. The process offers very good case-depth control, i.e., the variation of hardness as a function of depth can be controlled very precisely.

While considerable emphasis has been placed herein on the components and component parts of the various embodiments, it will be appreciated that many embodiments can be made and that many changes can be made in the embodiments without departing from the scope and spirit of the invention. These and other changes in the various embodiment of the disclosure will be apparent to those skilled in the art from the disclosure herein, whereby it is to be distinctly understood that the foregoing descriptive matter is to be interpreted merely as illustrative of the disclosure and not as a limitation.

What is claimed is:

1. A method of treating an article, the method consisting of the steps of:

heating the article to a temperature in a range of about 500 degrees centigrade to about 600 degrees centigrade in a cyanide-free nitriding bath to obtain a nitrided article;

heating the nitrided article to a temperature in a range of about 450 degrees centigrade to about 550 degrees centigrade in an atmosphere comprising nitrogen and carbon to obtain an oxidized nitrided article;

wherein the oxidized nitrided article has a corrosion resistance at least 10 times the corrosion resistance of the article, and wherein the article is a ferrule.

2. The method of claim 1, wherein the article comprises a low carbon steel.

3. The method of claim 1, wherein the cyanide-free nitriding bath comprises:

about 31 percent to about 40 percent of cyanate, about 17 percent to about 21 percent of carbonate, and less than about 1 percent of a cyanide compound.

4. The method of claim 1, wherein the cyanide-free nitriding bath has cyanide in a range of about 0 percent to about 1 percent.

5. The method of claim 1, further comprising the step of coating the oxidized nitrided article with a metallic coating to form a metal coated oxidized nitrided article.

6. The method of claim 5, wherein the metallic coating comprises a zinc, nickel, or a zinc-nickel alloy.

7. The method of claim 6, wherein, the metal coated oxidized nitrided article has a corrosion resistance of at least twenty times the corrosion resistance of the article.

8. The method of claim 1, wherein the cyanide-free nitriding bath comprises:

about 31 percent to about 40 percent of cyanate, about 17 percent to about 21 percent of carbonate, about 15 percent to about 25 percent of sodium, about 20 percent to about 30 percent % of potassium, about 1 percent to about 6 percent of lithium, less than about 1 percent of sulphur, and less than about 1 percent of a cyanide compound.

9. A method of treating an article, the method comprising the steps of:

heating the article to a temperature in a range of about 500 degrees centigrade to about 600 degrees centigrade in a cyanide-free nitriding bath to obtain a nitrided article;

heating the nitrided article to a temperature in a range of about 450 degrees centigrade to about 550 degrees centigrade in an atmosphere comprising nitrogen and carbon to obtain an oxidized nitrided article; and coating the oxidized nitrided article with a metallic coating to form a metal coated oxidized nitrided article;

wherein the metal coated oxidized nitrided article has a corrosion resistance at least twenty times the corrosion resistance of the article.

10. The method of claim 9, wherein the article is a ferrule.

11. The method of claim 9, wherein the article comprises a low carbon steel.

12. The method of claim 9, wherein the cyanide-free nitriding bath comprises:

about 31 percent to about 40 percent of cyanate, about 17 percent to about 21 percent of carbonate, and less than about 1 percent of a cyanide compound.

13. The method of claim 9, wherein the cyanide-free nitriding bath has cyanide in a range of about 0 percent to about 1 percent.

14. The method of claim 9, wherein the metallic coating comprises a zinc, nickel, or a zinc-nickel alloy.

15. The method of claim 9, wherein, the metal coated oxidized nitrided article has a corrosion resistance of at least twenty times the corrosion resistance of the article.

16. The method of claim 9, wherein the cyanide-free nitriding bath comprises:

about 31 percent to about 40 percent of cyanate, about 17 percent to about 21 percent of carbonate, about 15 percent to about 25 percent of sodium, about 20 percent to about 30 percent % of potassium, about 1 percent to about 6 percent of lithium, less than about 1 percent of sulphur, and less than about 1 percent of a cyanide compound.

* * * * *